United States Patent [19]

Stokes

[11] Patent Number: 4,702,047

[45] Date of Patent: Oct. 27, 1987

[54] GROUND ANCHORS

[75] Inventor: Bruce F. Stokes, Ruawai, New Zealand

[73] Assignee: Baramac Corporation Limited, Ruawai, New Zealand

[21] Appl. No.: 911,864

[22] Filed: Sep. 26, 1986

[30] Foreign Application Priority Data

Sep. 27, 1985 [NZ] New Zealand ..... 213634

[51] Int. Cl.[4] ..... E02D 5/80; B63B 21/24

[52] U.S. Cl. ..... 52/156; 52/157; 114/294; 114/295; 405/224

[58] Field of Search ..... 52/156, 157; 114/295, 114/294; 405/224

[56] References Cited

U.S. PATENT DOCUMENTS

| | | | |
|---|---|---|---|
| 315,593 | 4/1885 | Boehmke et al. | 52/157 |
| 571,624 | 11/1896 | Ryan | 114/295 X |
| 839,822 | 1/1907 | Dunnington | 52/157 |
| 995,297 | 6/1911 | Schroeder | 52/157 |
| 1,676,197 | 7/1928 | Marrinan | 52/156 |
| 2,084,239 | 6/1937 | Bradford | 52/156 |
| 2,156,021 | 4/1939 | Little | 52/156 X |
| 2,988,892 | 6/1961 | Borrmann et al. | 52/156 X |
| 3,991,977 | 11/1976 | Penttila | 254/264 |
| 4,315,387 | 2/1982 | Lee et al. | 52/156 |

FOREIGN PATENT DOCUMENTS

| | | | |
|---|---|---|---|
| 720032 | 4/1942 | Fed. Rep. of Germany . | |
| 8510265 | 7/1985 | Fed. Rep. of Germany . | |
| 413247 | 8/1910 | France . | |
| 1230157 | 9/1960 | France . | |
| 1565613 | 3/1969 | France | 114/294 |
| 2484355 | 12/1981 | France | 114/294 |

*Primary Examiner*—Alfred C. Perham
*Attorney, Agent, or Firm*—Holman & Stern

[57] ABSTRACT

A ground anchor is provided comprising a first part engageable within an anchoring medium such as, for example, the ground, along an insertion axis; a second part to which loads are, in use, attached; and linking means interconnecting the first and second parts yet permitting displacement of the second part with respect to the insertion axis; so that when load is applied to the second part after the first part has been inserted within the anchoring medium the second part can alter position without moving the first part and thus reduce the effective loading on the first part. The second part preferably includes supplementary anchoring which penetrates the surface of the anchoring medium upon application of load to the anchor.

20 Claims, 17 Drawing Figures

GROUND ANCHORS

BACKGROUND OF THE INVENTION

1. Field of the Invention

This invention relates to ground anchors. More particularly invention relates ground anchors to which facilitate the recovery of stranded vehicles and a wide variety of other applications.

2. Description of the Prior Art

In the past ground anchoring has been provided in a somewhat arbitrary manner regardless of the particular situation. For example a typical method of recovering a stranded vehicle comprises attaching a line between the vehicle and a fixed object such as a tree and then attaching a winch in the line and winching the vehicle to firm ground. If there is no tree in the near vicinity one alternative is to dig a deep hole in "firm" ground, attach the recovery line to the vehicle spare wheel and then bury the spare wheel in the hole to provide the anchor. In many instances, however, the direct loading applied to such an anchor will merely withdraw the anchor.

U.S. Pat. No. 3,991,977 to Pentilla discloses a form of vehicle jack which may be used for vehicle recovery, however the anchoring point is a simple stake driven into the ground and obviously in softer grounds the stake will merely be pulled over and ultimately be withdrawn from the ground as load is applied.

Likewise in most other anchoring situations, the load applied to the anchor is applied directly to the point of purchase of the anchor in the anchoring medium and thus, where the load is high the size of the anchor must be large. This in turn leads to problems with insertion and removal.

It is an object of the invention to provide a ground anchor which will overcome the above problems and provide the public with a useful choice.

SUMMARY OF THE INVENTION

Accordingly the invention consists in a ground anchor comprising a first part engageable within an anchoring medium beneath the surface thereof and having an insertion axis; a second part having load attachment means; and linking means operatively connecting said first part and said second part, said linking means being operable to transfer load applied at said second part to said first part yet allow displacement of said second part with respect to said insertion axis.

In this context "anchoring medium" means the medium in which the anchor is retained such as, for example, the ground. It will be appreciated that the composition of the ground varies widely but it will be appreciated, from the following description, that embodiments of ground anchors according to the invention may be retained in a range of media including sand, mud and rock.

In many situations, and where physically possible, the second part provides supplementary anchoring. To this end the second part preferably includes means to penetrate the surface of the anchoring medium, the point of penetration constituting an anchoring point spaced from the anchoring point of the first part and thus increasing the anchoring power of the apparatus.

The linking means is preferably of a form which permits the first part to be inserted into the ground by manipulation of the second part. Further, the linking means is preferably configured to allow arcuate movement of the second part with respect to the first part.

Typically the first part comprises an auger. The precise configuration of the auger will depend on the anchoring medium or media likely to be encounted.

The second part typically includes an attachment eye and, where supplementary anchoring is to be provided, preferably includes one or more laterally extending shafts arranged to lie substantially parallel to the ground when the first part is anchored within the ground. The laterally extending shaft or shafts not only facilitate insertion of the anchor but further provide convenient mounting pionts for plate like members which, as the anchor is placed under load, penetrate the ground surface.

The linking means may comprise a pair of shafts, one connected to each of the first and second parts, the shafts being preferably joined together by a pivotal joint to allow arcuate displacement of the first part with respect to the second part. It will be appreciated, however, that the precise form of the linking means could take many other forms.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DESCRIPTION OF THE DRAWINGS

The invention will now be described with reference to the accompanying drawings wherein.

DESCRIPTION OF THE PREFERRED EMBODIMENT

Figures 1, 2, 3:
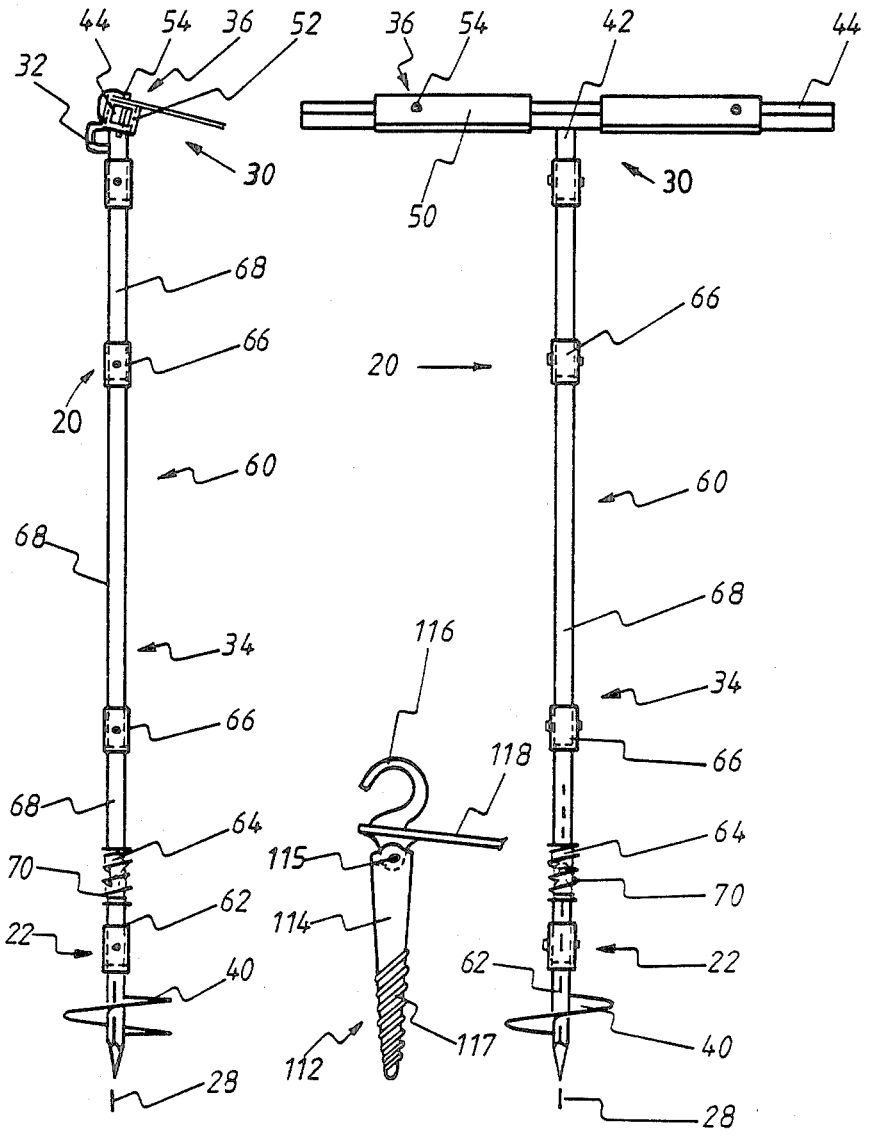
FIG. 1 is a front elevational view of one form of ground anchor according to the invention.
FIG. 2 is a left side view of the anchor depicted in FIG. 1.
FIG. 3 is an elevational view of a simple form of ground anchor according to the invention suitable for use as a tent peg.

Referring to the drawings and in particular to FIGS. 1 and 2 a ground anchor 20 is depicted comprising a first part 22 engageable within an anchoring medium 24 (FIG. 4) and beneath the surface 26 of the medium, the first part 22 having an insertion axis 28. The anchor 20 further includes a second part 30 having load attachment means 32 and linking means 34 interconnecting the first part 22 and the second part 30, the linking means being operable to transfer at least some of the load applied at the load attachment means 32 to the first part 22 yet permit displacement of the second part 30 with respect to the insertion axis 28. As will be apparent hereinafter this displacement with respect to the axis 28 is preferably rotational or acurate displacement.

A ground anchor according to the invention preferably further includes supplementary anchoring in the form of second ground engaging means 36 attached to or forming part of the second part 30, the second ground engaging means 36 engaging the surface 26 of the anchoring medium when the anchor is in use.

The arrangement of the linking means 34 is preferably such as to allow the first part 22 to be inserted within the anchoring medium by manipulation of the second part 30. As can be seen from the drawings the first part 22 preferably includes or comprises a ground engaging auger 40 and thus the manipulation required to insert the auger is rotation. Depending on the size of the apparatus and the anchoring medium such rotation can be effected manually or by machine.

The configuration of the auger 40 will again depend on the anchoring medium and the anticipated load to be applied to the anchor. The precise configuration of the auger is not essential and is not considered to be part of the invention.

As described hereinabove the second part 30 carries the load attachment means 32 to which suitable loads may be applied, the means 32 preferably comprising a simple eye. It will be appreciated, however, that various other forms of load engaging means could be substituted for the eye 32.

A handle is preferably incorporated in the second part 30. As shown this handle is provided by a t-member 42 which includes a transverse shaft 44, the shaft 44 being arranged substantially perpendicular to the insertion axis 28 of the first part 22 when the anchor is unloaded. Thus it will be appreciated that by gripping the shaft 44 rotation may easily be applied to the auger 40.

The shaft 44 also conveniently serves to mount the second ground engaging means 36. In the form shown the means 36 comprises a pair of plate members 50 welded or otherwise fixed to the periphery of sleeves 52, the inside surfaces of the sleeves 52 forming a sliding fit over the shaft 44. A pair of quick release type pins 54 pass through apertures (not shown) in the sleeves 52 and through correspondingly positioned apertures (not shown) provided through the shaft 44 thus enabling the sleeves 52 and thus the plates 50 to be locked in position with respect to the shaft 44.

As can be seen in FIG. 1 the plate members 50 are of a simple rectangular shape. The size and shape of the plate members 50 are, however, not considered part of the invention and will vary according to anchoring media and to anticipated working loads. Further, different combinations of shape and size of plate may be provided on the shaft 44.

In FIG. 2 the plates 50 are shown as projecting at about 75° to the insertion axis 28 when the anchor is unloaded and we have found that this alignment provides a good compromise for most anchoring media. For very soft grounds and for sand the plates 50 should be substantially perpendicular to the axis 28 when the anchor is in the configuration shown in FIGS. 1 and 2. For harder media such as, for example, clay the plates should be angled at closer to 45° from the insertion axis.

The linking means 34 interconnecting the first part 22 to the second part 30 may be of a wide variety of configurations, the essential requirement being that it permit displacement of the second part 30 with respect to the insertion axis 28. This, in turn, reduces the direct withdrawal loading on the first part 22 as load is applied to the second part 30 and therefore reduces the likelihood of the first part 22 being withdrawn under load.

In the embodiment depicted in FIGS. 1 and 2 the linking means comprises a pair of substantially rigid elongate members 60 and 62 interconnected by a pivotal joint 64. The elongated members 60 and 62 preferably comprise simple shafts but each may comprise one or more sections 68 interconnected by joints 66.

The pivotal joint 64, in the form shown, comprises a simple universal-type knuckle joint which allows torque to be transferred between the elongated members 60 and 62 yet permits a wide range of pivotal movement between the same two members. A simple coil spring 70 may be located about the joint 64 to bias the elongate members 60 and 62 into a concentric relationship when the anchor is unloaded and thus facilitate placement and removal of the auger 40 from the ground 24.

Figure 9:
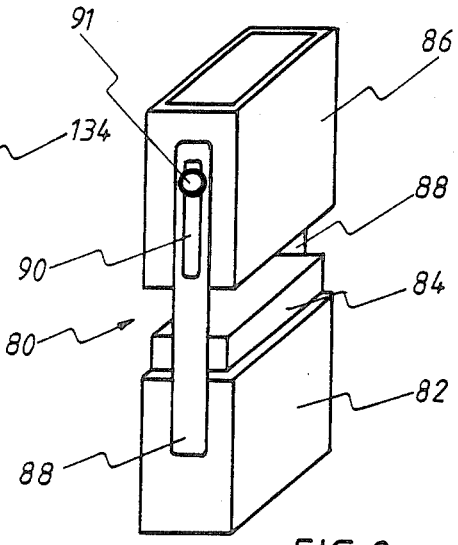
FIGS. 9 to 12 are perspective views of alternative forms of joint for use in the linking part of a ground anchor according to the invention.

Turning now to FIGS. 9 to 12 various alternative forms of joint are depicted which could conveniently be substituted for the joint 64 above described. In FIG. 9 a spigot type joint 80 is depicted in which an end of one of the elongate members 82 is provided with the male section 84 of a spigot which is engageable within a female socket (not shown) provided in the adjacent end of the other elongate member 86. A pair of spaced plate members 88 project upwardly from opposed sides of the elongate member 82 and receive the end of the member 86 therebetween. The upper section of each of the plate members 88 has an elongate slot 90 therein and the joint is completed by means of studs 91 which pass through the slots and are fixed within the elongate member 86. Thus it will be appreciated that by sliding the member 86 towards the member 82 the spigot engages and thus torque applied to the member 86 may be transferred to the member 82 and vice-versa. At the completion of insertion of the auger 40 the members 86 and 82 may be relatively displaced to disengage the spigot whereupon member 86 may pivot with respect to member 82 by the sides of the slots 90 rotating about studs 91.

Figure 10:
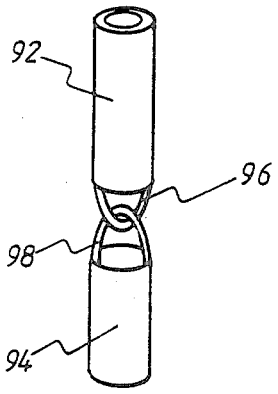

Turning now to FIG. 10 the concentric members 92 and 94 which form part of the linking means are interengaged by simple chain-like links 96 and 98 which, in use, bind to permit torque to be transferred between the members 92 and 94 yet also permit virtually universal pivotal movement between the members 92 and 94. As with the joint depicted in FIGS. 1 and 2 a simple coil spring (not shown) may be provided about the joint formed by the links 96 and 98 to return the members 92 and 94 to a concentric relationship when free of load.

Figure 11:
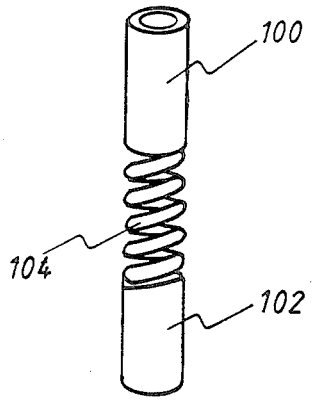

In FIG. 11 the shaft members 100 and 102 are interconnected by a relatively stiff coil spring 104. The spring is sufficiently rigid to permit torque to be transferred between the members 100 and 102 yet also permit universal pivotal movement between the members.

Figure 12:
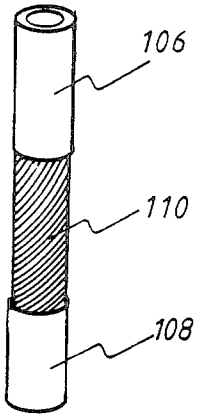

In FIG. 12 the elongate members 106 and 108 are interconnected by a length of wire rope type material 110. The wire rope 110 is of the type which can transfer torque between the members 106 and 108 yet permit pivotal type movement. A suitable type of wire rope is that sold under the trade mark DYFORM. The end of the members 106 and 108 are crimped or otherwise fixed to the rope material 110.

The joint, whatever form it may take, will be positioned between the point of load application and the point of retention of the first part according to the intended application for the anchor as will be apparent by comparing the different forms of anchor shown in FIGS. 1,3,6 and 8.

Referring to FIG. 3 a simple type of anchor 112 according to the invention is depicted in which the first part comprises a tapered spike 114 and the second part a simple hook 116 attached to one end of the spike 114 through pivot pin 115. The spike may include peripheral grooving 117 to enhance grip while integrally mounted with the hook 116 is a plate member 118 which pivots to penetrate the ground surface as load is applied to hook 116.

Figure 8:
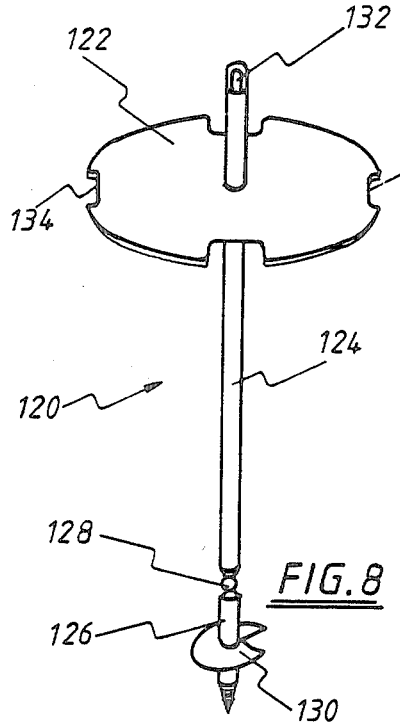
FIG. 8 is a perspective view of a further of ground anchor according to the invention particularly suitable for anchoring marine craft.

Turning now to FIG. 8 a still further embodiment of ground anchor 120 is shown having a substantially circular plate member 122 to provide the second ground engaging means. The plate 122 is fixed to shaft 124 which in turn is fixed to shaft 126 through a knuckle-type joint 128. The lower shaft 126 is provided with a ground engaging auger 130 while a load attachment eye 132 projects above the plate member 122.

The plate member 122 may be provided with hand grips 134 to facilitate rotation of the auger 130 into the ground.

A ground anchor of one of the types described has a wide variety of uses. While the apparatus was initially developed to facilitate vehicle recovery, embodiments of the apparatus have a wide variety of applications in fields as diverse as vehicle recovery, civil engineering, rock climbing, forestry, irrigation and so on. Indeed, a ground anchor according to the invention may have application virtually anywhere where one object must be anchored with respect to another.

Figure 4A:
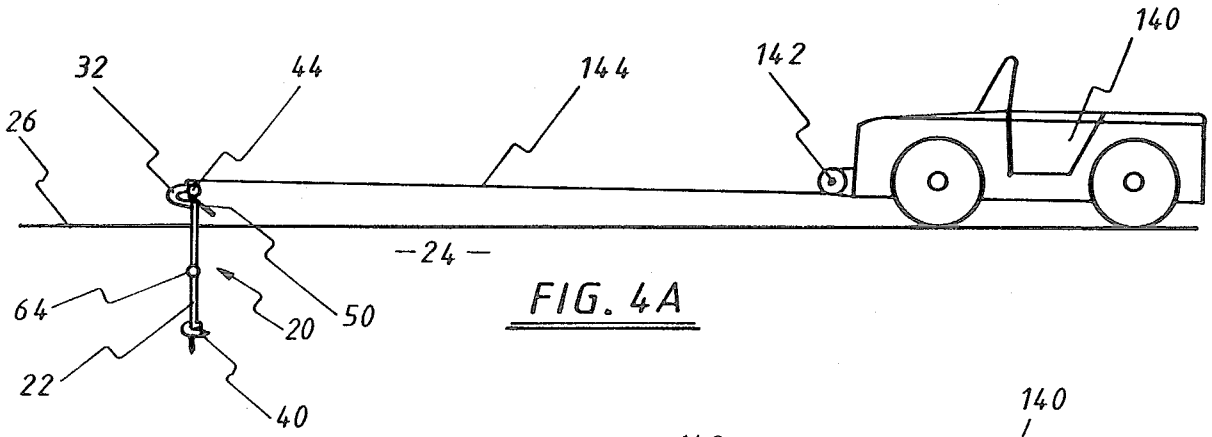
FIGS. 4A and 4B are schematic successive views of the ground anchor depicted in FIGS. 1 to 3 in use.
Figure 4B:
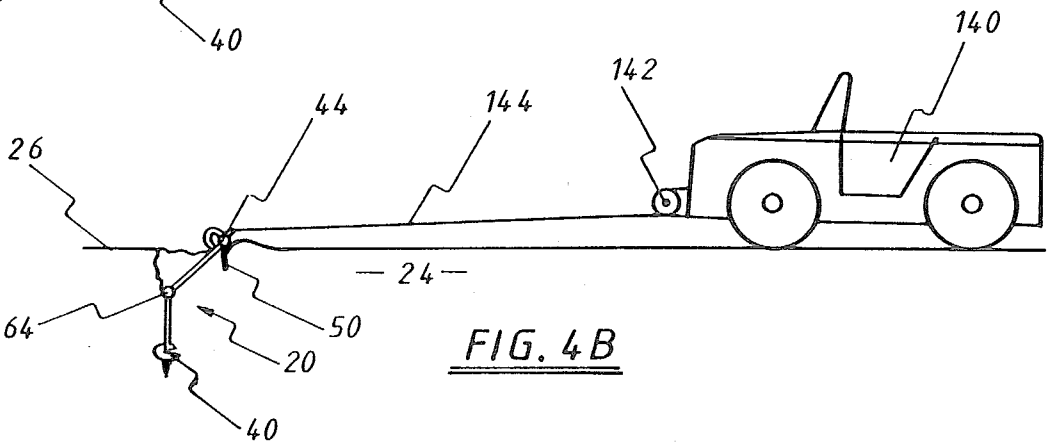

Referring now to FIGS. 4A and 4B a ground anchor of the type depicted in FIGS. 1 and 2 is shown being used to recover a stranded motor vehicle 140, the vehicle 140 being provided with a winch 142 adjacent to the forward edge thereof.

Recovery of the vehicle is effected by inserting ground anchor 20 within the ground in a position spaced from the vehicle 140 and so that the first part 22 is embedded in the ground and the pivot joint 64 is also located beneath the ground surface. In practice the anchor is inserted into the ground so that the handle shaft 44 lies just above the ground surface and so that the load attachment eye 32 is behind the shaft 44 when viewed with respect to the vehicle 140.

Once the anchor has been positioned a cable 144 is withdrawn from the winch 142, passed over handle shaft 44 and attached to the load bearing eye 32. The winch 142 is then accuated which initially pivots the upper part of the anchor about pivot 64 until the plates 50, if fitted, dig into the ground surface as shown in 4B. Providing the anchor is of a suitable configuration for the load and the anchoring medium the anchor will thereafter stay relatively firm thus providing the anchorage for the vehicle to be withdrawn. After the vehicle has been winched to firm ground the cable 144 is detached from eye 32 and the handle shaft 44 manipulated to remove auger 40 from the ground.

It will be appreciated that when the ground anchor is in the configuration shown in FIG. 4B there are two spaced fixing points which obviously provide a more effective purchase than a single point. Further, since the load applied by the winch is not directly along the insertion axis 28 or the axis of section 22 then the force tending to withdraw the auger 40 is substantially less than it would be if there was no pivot joint 64.

Figure 5:
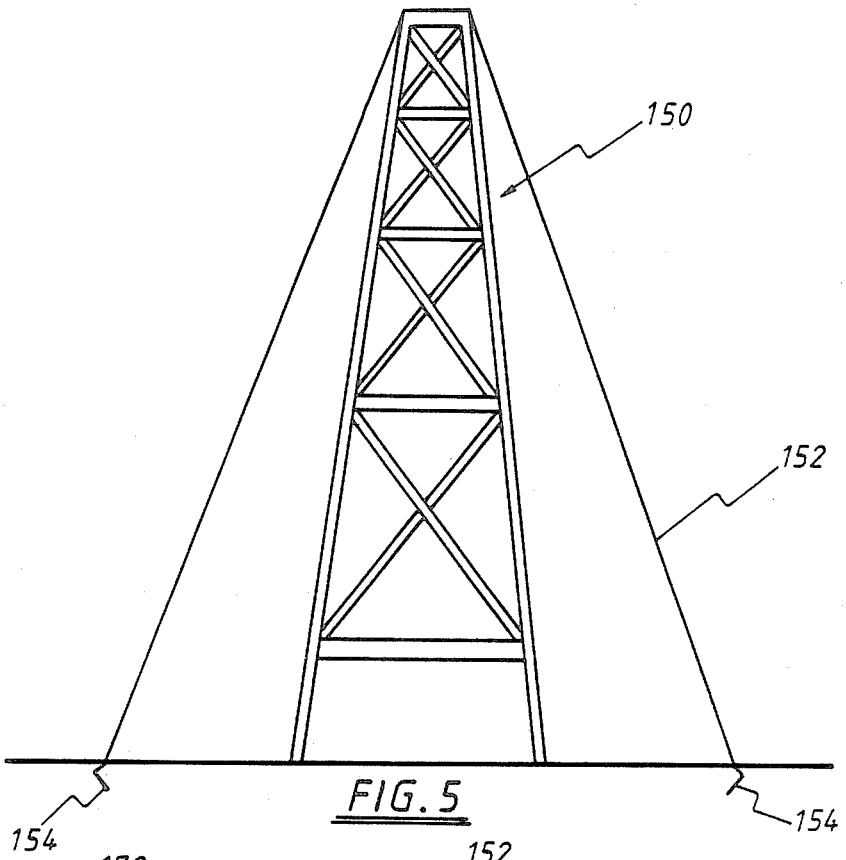
FIG. 5 is a schematic view of a tower-like structure anchored using a ground anchor according to the invention.

It will be appreciated that for the plates 50 to operate effectively the load applied to the ground anchor must be applied along a relatively shallow angle. However, embodiments of a ground anchor according to the invention have been devised to effect anchoring where the applied load is of a much sharper angle such as is shown in FIG. 5 where a tower 150 is shown as being anchored by stays 152 attached to anchors 154.

Figure 6:
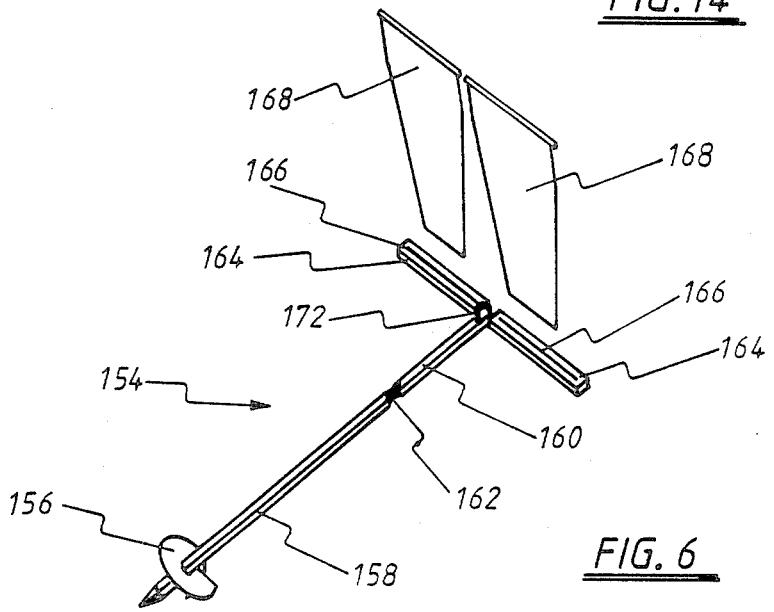
FIG. 6 is a perspective view of a form of ground anchor suitable for effecting anchoring of the structure depicted in FIG. 5.

Turning now to FIG. 6 the anchors 154 in the form shown, each comprise an auger 156 mounted on the lower end of first shaft 158. Second shaft 160 is mounted concentrically with shaft 158 through a pivotal joint 162 and includes outwardly projecting handles 164. The handles 164 include slots 166 through which, in use, additional plates 168 may be passed and, in turn, fixed.

Figures 7A, 7B, 7C:
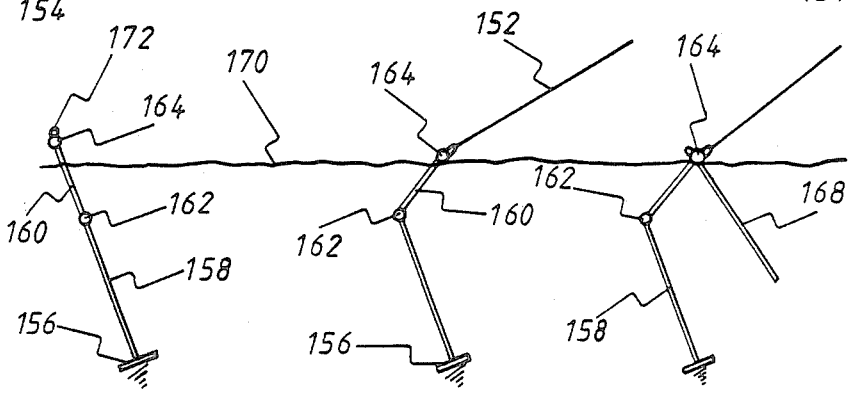
FIGS. 7A to 7C are schematic views showing successive steps in inserting the ground anchor depicted in FIG. 6.

As the first step in anchoring the tower 150, anchors 154 of the type described are positioned at points horizontally spaced about the tower 150 at ground level and are inserted in position as shown in FIG. 7A so that the pivot joints 162 are positioned beneath the ground surface 170 but so that the attachment eyes 172 and handle members 164 are positioned just above the ground surface. The stays 152 are then attached to the load attachment eyes 172 and are tensioned to an amount sufficient to pivot the upper anchor section 160 about joint 162 so that the handles 164 lie against the ground 170 as shown in FIG. 7B. The plates 168 are then passed through the slots 164 in the handles as shown in FIG. 7C and are fixed in position by any suitable means. The stays 152 are then finally tensioned to fix the tower 150 in position.

Figure 13:
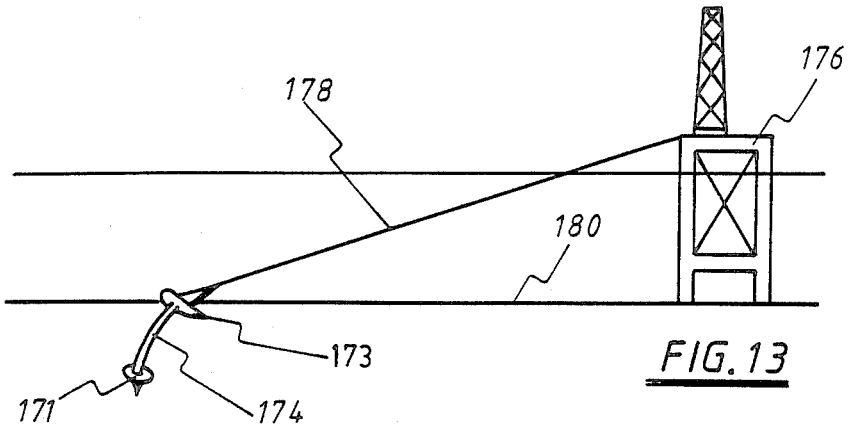
FIG. 13 is a schematic view of a conventional type of undersea anchor incorporated into a ground anchor according to the invention serving to anchor an offshore oil rig.

Referring now to FIG. 13 a ground anchor according to the invention may also be used, in combination with a more conventional form of undersea anchor, to enhance anchoring under water of, for example, oil rigs and similar structures. As shown in FIG. 13 an auger 171 is buried into the seabed and is fixed to a more conventional undersea anchor 173 by, for example, a wire rope or some other link 174 which permits some displacement of the anchor 173 with respect to the auger 171. The anchor 173, which may be of the DANFORTH type, is then attached to the structure 176 by cable 178 and the cable tensioned. Since the anchor 173 is, itself, anchored by the auger 171 it is thus drawn more effectively into the seabed 180 as tensioning takes place.

Figure 14:
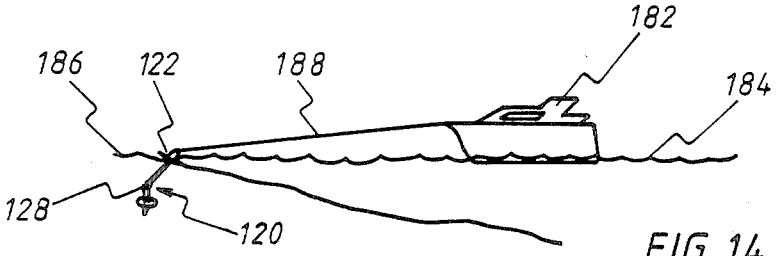
FIG. 14 is a schematic view of a ground anchor of the type depicted in FIG. 8 in use mooring a marine craft.

Referring now to FIG. 14 a ground anchor 120 of the type depicted in FIG. 8 is shown in use anchoring a marine craft 182 afloat on the water surface 184. The anchor 120 is screwed into the seabed 186 by manual manipulation of the upper plate section 122 and as load is applied by the craft 182 through cable 188 an edge portion of the plate 122 is drawn into the surface of the seabed 186. Providing the joint 128 is of the universal type then an edge portion of the plate 122 will be drawn into the seabed no matter what the position of the craft 182 is.

It will thus be appreciated that the present invention provides a relatively simple yet highly effective form of anchor which, owing to the unique arrangement of the various parts means that an effective anchor can be achieved even where the anchoring medium is relatively unstable. By varying the size and precise configuration of the various components many different objects may be anchored in position.

I claim:

1. A ground anchor comprising:

a first part insertable for engagement within an anchoring medium beneath the surface of the ground and having an insertion axis;

a second part;

load attachment means on said second part;

second ground engaging means on said second part operable in use for penetrating the surface of the ground upon load being applied to said anchor; and linking means operatively connecting said first part and said second part, said linking means being operable to transfer load applied at said second part to said first part and allow displacement of said second part with respect to said insertion axis.

2. An anchor as claimed in claim 13 wherein said first part includes an auger.

3. An anchor as claimed in claim 13 wherein said linking means comprises:

a pair of elongate members; and a joint interconnecting said elongate members, said joint being constructed and arranged to permit arcuate movement of one elongate member with respect to the other elongate member.

4. An anchor as claimed in claim 3 wherein said joint is further constructed and arranged to permit torque to be transferred between said elongate members.

5. An anchor as claimed in claim 4 wherein said joint comprises a universal-type knuckle joint.

6. An anchor as claimed in claim 5 wherein said first part includes an auger.

7. An anchor as claimed in claim 6 and further comprising:

biasing means operably associated with said joint for urging said elongate members into concentric alignment when said anchor is free of load.

8. An anchor as claimed in claim 7 wherein said biasing means comprises a coil spring surrounding said joint.

9. An anchor as claimed in claim 8 wherein said second ground engaging means comprises: at least one plate member projecting at an angle to said insertion axis when said anchor is unloaded.

10. An anchor as claimed in claim 9 wherein said second part further comprises: a shaft member projecting substantially perpendicular to said insertion axis when said anchor is unloaded and wherein at least one plate member is mounted on said shaft.

11. An anchor as claimed in claim 10 wherein:

said shaft member projects on opposite sides of said insertion axis; and said at least one plate member comprises a plurality of plate members distributed on opposite sides of said insertion axis.

12. An anchor as claimed in claim 4 and further comprising:

biasing means operably associated with said joint for urging said elongate members into concentric alignment when said anchor is free of load.

13. An anchor as claimed in claim 12 wherein said biasing means comprises a coil spring surrounding said joint.

14. An anchor as claimed in Claim 4 wherein said joint comprises:

a sliding spigot type joint having interconnectable male and female parts, one of said elongate members including said male part and the other of said elongate members including said female part; and link means interconnecting said elongate members and being operable to permit pivotal movement of said elongate members upon disconnection of said male and female parts.

15. An anchor as claimed in Claim 4 wherein said joint comprises:

a pair of interconnected chain-like links which, upon application of torque to one of said elongate members, bind so as to transfer torque from one elongate member to the other elongate member.

16. An anchor as claimed in claim 4 wherein said joint comprises a coil spring.

17. An anchor as claimed in claim 4 wherein said joint comprises a wire rope.

18. An anchor as claimed in claim 1 wherein said second ground engaging means comprises: at least one plate member projecting at an angle to said insertion axis when said anchor is unloaded.

19. An anchor as claimed in claim 18 wherein said second part further comprises:

a shaft member projecting substantially perpendicular to said insertion axis when said anchor is unloaded and wherein at least one plate member is mounted on said shaft.

20. An anchor as claimed in claim 18 wherein said at least one plate member comprises a substantially circular disk substantially concentrically disposed with respect to said insertion axis.

* * * * *